US005445583A

United States Patent [19]

Habing

[11] Patent Number: 5,445,583

[45] Date of Patent: Aug. 29, 1995

[54] FLOATING BACK PAD LEG EXERCISER

[75] Inventor: Theodore G. Habing, Long Beach, Calif.

[73] Assignee: Pacific Fitness Corporation, Cypress, Calif.

[21] Appl. No.: 371,586

[22] Filed: Jan. 12, 1995

Related U.S. Application Data

[63] Continuation of Ser. No. 97,756, Jul. 26, 1993, abandoned, which is a continuation-in-part of Ser. No. 838,158, Feb. 18, 1992, Pat. No. 5,254,067, which is a continuation-in-part of Ser. No. 541,919, Jun. 21, 1990, abandoned.

[51] Int. Cl.[6] ..... A63B 22/04

[52] U.S. Cl. ..... 482/52; 482/57; 482/137; 482/142

[58] Field of Search ..... 482/51–53, 482/57–65, 70–72, 95, 96, 112–113, 133–138, 142, 908

[56] References Cited

U.S. PATENT DOCUMENTS

| | | | |
|---|---|---|---|
| 3,058,742 | 10/1962 | Jaffe | 482/63 X |
| 3,501,142 | 3/1970 | Johansson | 482/63 X |
| 3,563,541 | 2/1971 | Sanquist | 482/57 X |
| 3,722,882 | 3/1973 | Partick | 482/57 |
| 3,751,033 | 8/1973 | Rosenthal | 482/63 X |
| 4,285,515 | 8/1981 | Gezari | 482/57 |
| 4,372,551 | 2/1983 | Yurdin | 482/57 |
| 4,511,137 | 4/1985 | Jones | 482/137 X |
| 4,519,604 | 5/1985 | Arzounian | 482/57 |
| 4,700,946 | 10/1987 | Breunig | 482/96 X |
| 4,708,338 | 11/1987 | Potts . | |
| 4,765,615 | 8/1988 | Case | 482/908 X |
| 4,786,069 | 11/1988 | Tang | 482/51 X |
| 4,807,874 | 2/1989 | Little | 482/908 X |
| 4,822,032 | 4/1989 | Whitmore et al. | 482/63 |
| 4,842,268 | 6/1989 | Jenkins | 482/63 X |
| 4,880,227 | 11/1989 | Sowell | 482/57 X |
| 4,909,504 | 5/1990 | Yang | 482/51 X |
| 4,938,474 | 7/1990 | Sweeney et al. . | |
| 4,949,993 | 8/1990 | Stark et al. . | |
| 5,039,088 | 8/1991 | Shifferaw | 482/63 X |
| 5,169,363 | 12/1992 | Campanaro et al. | 482/96 |
| 5,215,511 | 6/1993 | Cheng | 482/133 X |

FOREIGN PATENT DOCUMENTS

| | | | |
|---|---|---|---|
| 966523 | 6/1975 | Canada | 482/137 |

OTHER PUBLICATIONS

The Gravity Edge (advertisement).
HealthRider (brochure).
The Crossrobics 1650 LE brochure, Stairmaster Sports/Medical Products, Inc.
Total Gym (brochure, EFI/Total Gym).

*Primary Examiner*—Richard J. Apley
*Assistant Examiner*—John Mulcahy
*Attorney, Agent, or Firm*—Blakely, Sokoloff, Taylor & Zafman

[57] ABSTRACT

An exercise machine supports the user with a backrest that is slideable along a guide member. The guide member extends upwardly from the frame of the machine and is inclined to the rear so that the user is supported in a semi-recumbent position. A pair of longitudinal beams are pivotally mounted on either side of the frame. Footpads are provided at the forward ends of the beams so that a user of the apparatus can comfortably engage the beams with his feet. The beams independently pivot on the frame so that the user can operate them in an alternating reciprocating fashion. A resistance mechanism resists the downward movement of the beams and a biasing force is provided to return the beams in an upward direction. To utilize the apparatus, the user engages the footpads with his feet and then presses against the footpads to elevate the backrest along the guide member. The resistance level is then gradually reduced and the user maintains an elevated position with a striding action against the beams. For any particular level of resistance, the user and the backrest will "float" at a height that varies as a function of the effort exerted by the user, the object of the exercise being to stay "afloat".

21 Claims, 6 Drawing Sheets

FIG. 5
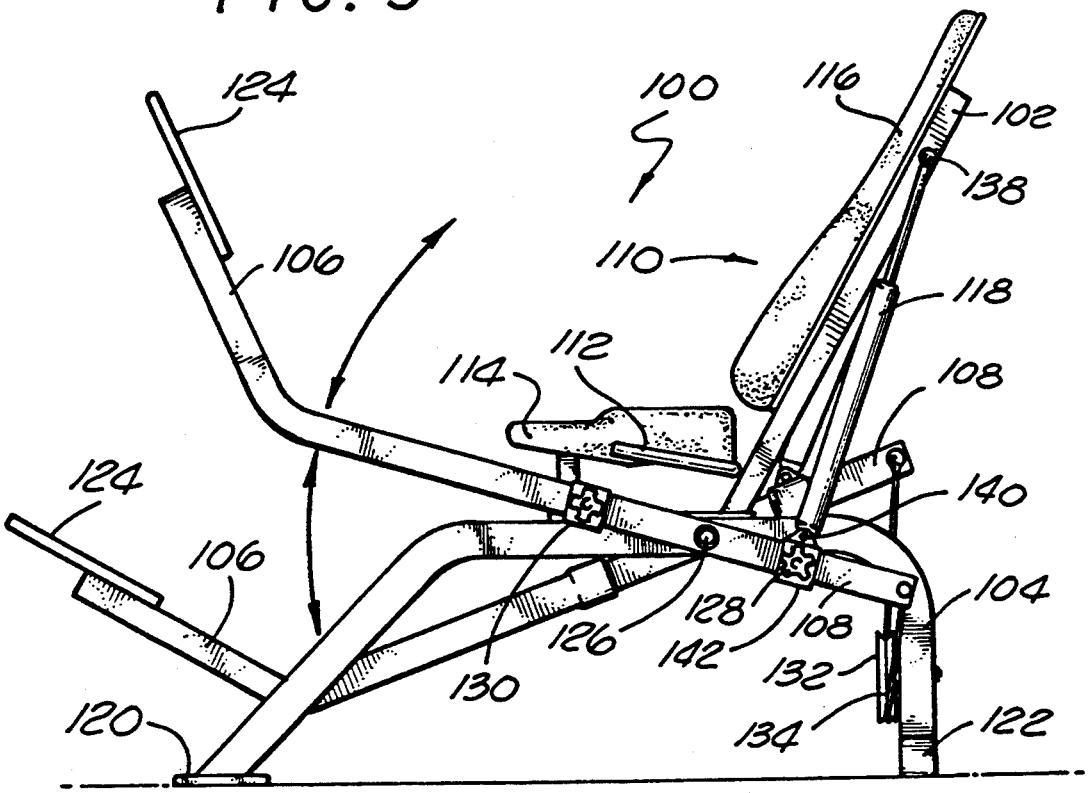
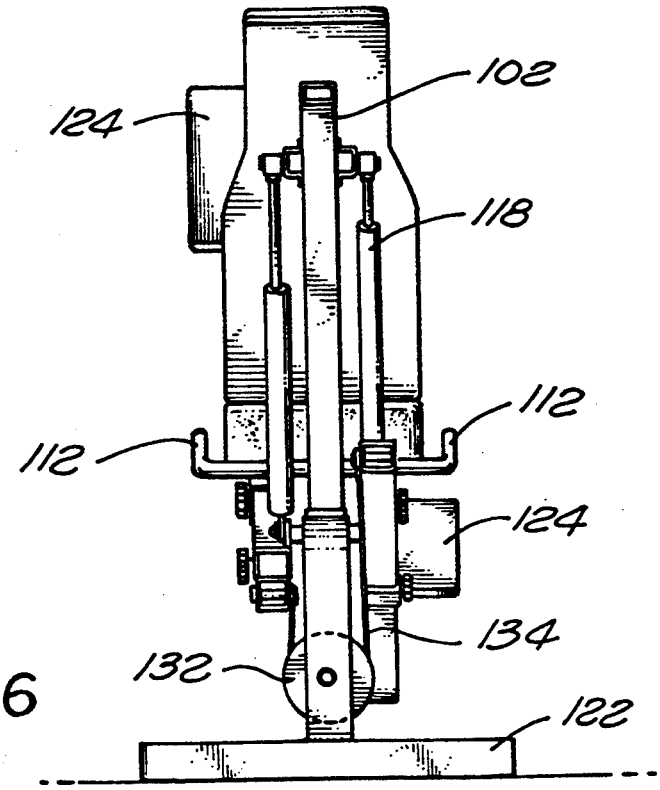
FIG. 6

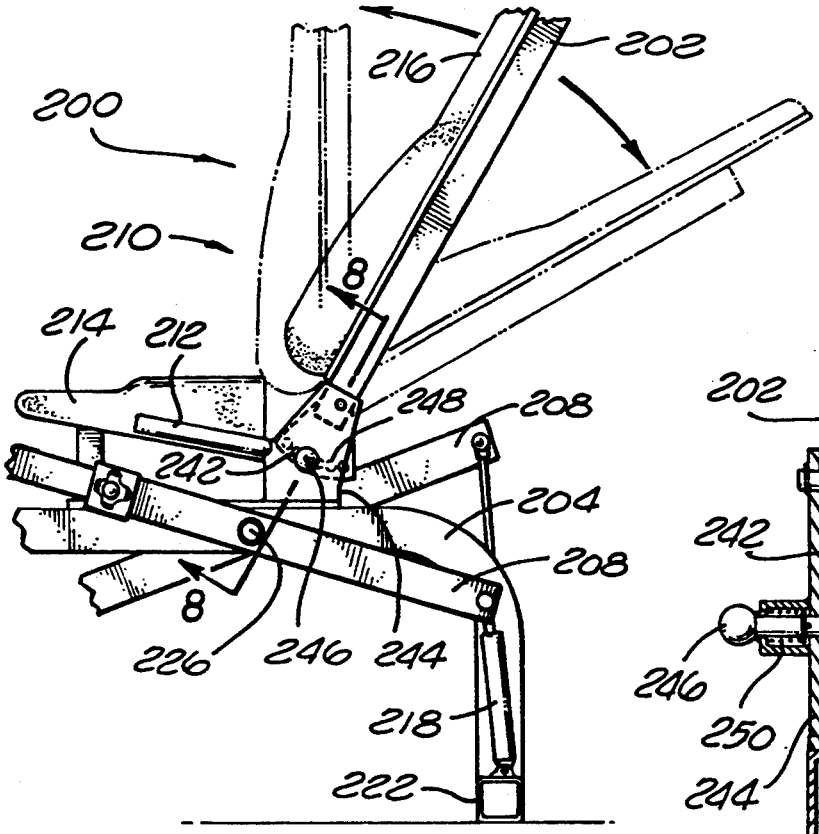
FIG. 7
FIG. 8
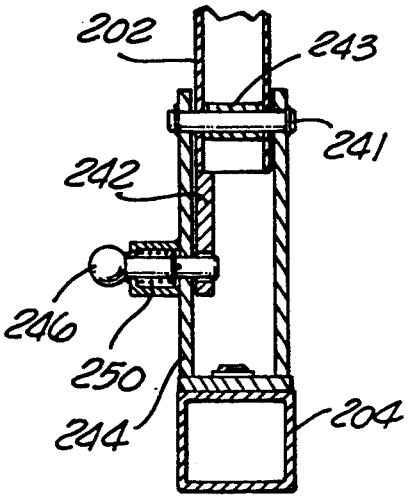

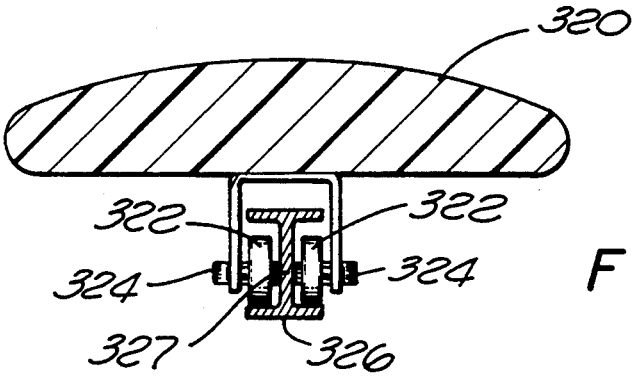
FIG. 10
FIG. 11
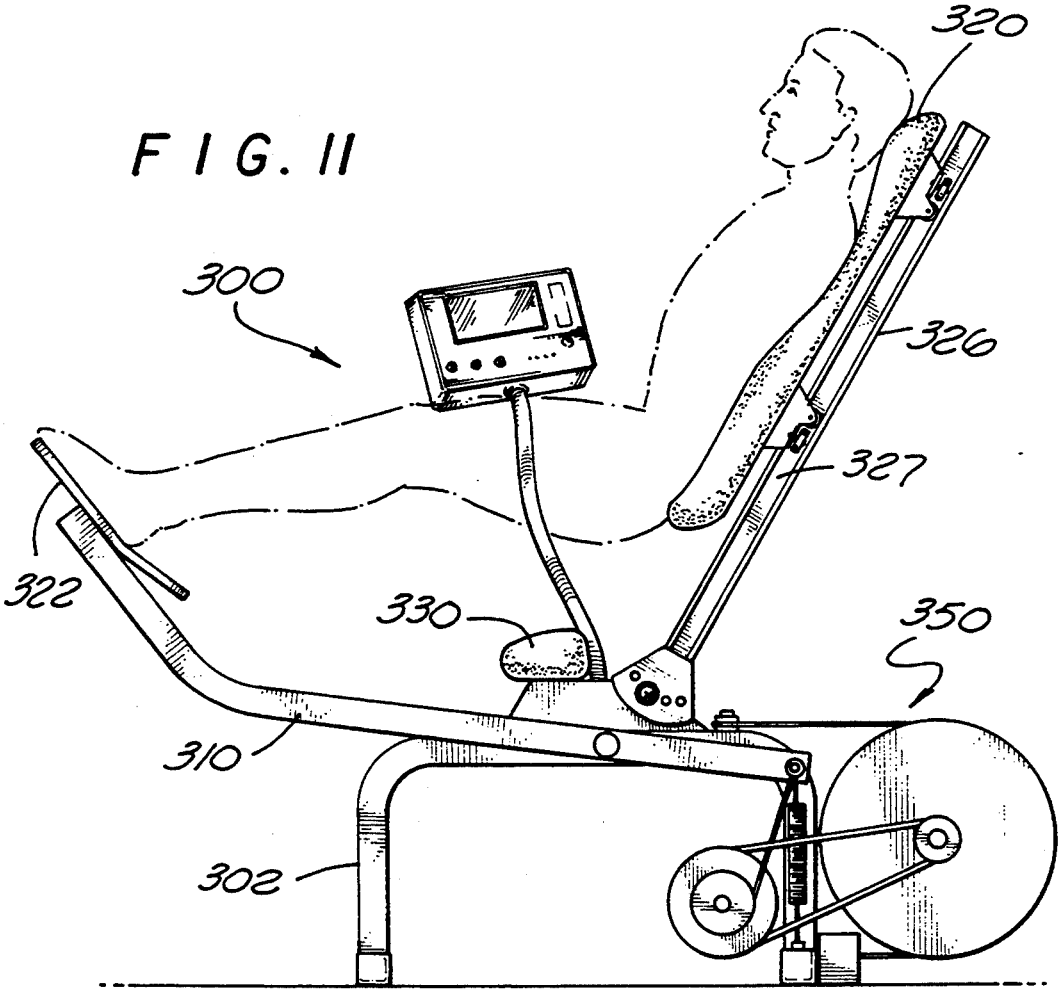

FLOATING BACK PAD LEG EXERCISER

This is a continuation of application Ser. No. 08/097,756, filed Jul. 26, 1993, now abandoned, which is a continuation-in-part of application Ser. No. 07/838,158, filed Feb. 18, 1992, now U.S. Pat. No. 5,254,067, which is a continuation-in-part of Ser. No. 07/541,919, filed Jun. 21, 1990, now abandoned.

BACKGROUND OF THE INVENTION

1. Field of the Invention

This invention relates to exercise equipment, and particularly to an apparatus in which a recumbent user may engage in both leg development and aerobic exercise.

2. Background Art

There and a wide variety of well-known exercise devices for developing the muscle groups of the legs. For example, the leg press exercise, whereby a recumbent person pushes against a resistance with one or both legs, may be performed on a number of dedicated exercise machines and on many multi-station machines as well.

Another ,class of leg exercise devices are those that simulate riding a bicycle. Generally these are intended to provide aerobic exercise in addition to development of the leg muscles. Some such devices are generally upright in the manner of a conventional bicycle, while others are configured so that the user is in a recumbent position while pedaling. Such a position provides greater support for the user's back and is generally more comfortable, especially for extended periods of use.

Recently, a number of exercise machines have been commercially introduced that simulate stair climbing. These devices are also generally intended to provide aerobic exercise as well as development of the leg muscles. One example of such a device is disclosed in U.S. Pat. No. 4,838,543.

One of the objects of the present invention is to provide an exercise apparatus that combines the comfort and support of a semi-recumbent exercise position with a striding-type of exercise such as is afforded by conventional upright devices of the type that simulate stair climbing.

Another object of the present invention is to provide a semi-recumbent leg exerciser that encourages a predetermined level of exertion by the user.

Yet another object of the present invention is to provide a semi-recumbent leg exerciser that is capable of selectively emphasizing different muscle groups.

SUMMARY OF THE INVENTION

The present invention is constructed on a longitudinal frame supported on the floor. A support for the user comprises a small fixed seat cushion and a backrest that is slideable along a guide member. The guide member extends upwardly from the frame and is inclined to the rear so that the user is supported in a semi-recumbent position.

A pair of longitudinal beams are pivotally mounted on either side of the frame. Footpads are provided at the forward ends of the beams so that a user of the apparatus can comfortably engage the beams with his feet. The beams independently pivot on the frame so that the user can operate them in an alternating reciprocating fashion. A resistance mechanism resists the downward movement of the beams and a biasing force is provided to return the beams in an upward direction.

To utilize the apparatus, the user first sits on the seat cushion and engages the footpads with his feet. The beams are restrained in an upper, starting position by the resistance mechanism, and the user presses against the footpads to elevate the backrest along the guide member. The amount of resistance is then gradually released, and the user maintains an elevated position with a striding action against the beams. For any particular level of resistance, the user and the backrest will "float" at a height that varies as a function of the effort exerted by the user, the object of the exercise being to stay "afloat". The height at which the user and backrest float will fluctuate depending upon the nature and depth of the user's stride. This effect is similar to the height fluctuation that occurs when using a conventional stair-climbing simulator. Gravity is a natural exercise motivator with the apparatus of the present invention as it is with stair-climbing simulators such as Sweeney et al.

The apparatus may also be operated in the manner of a conventional stair-climbing simulator. For this purpose, the footpads; have a secondary operating surface so that the user can stand in an erect posture.

BRIEF DESCRIPTION OF THE DRAWINGS

FIG. 5 is a side elevation view of another recumbent leg exerciser.

FIG. 6 is an end view of the exerciser of FIG. 5.

FIG. 7 is a detailed view of an exerciser having a reclining seat.

FIG. 8 is a sectional view taken along line 8—8 of FIG. 7.

FIG. 10 is a sectional view taken along line 10—10 of FIG. 9.

FIG. 11 is a side elevation view of the apparatus of FIG. 9 illustrating the backrest in an elevated "floating" position.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

Figure 1:
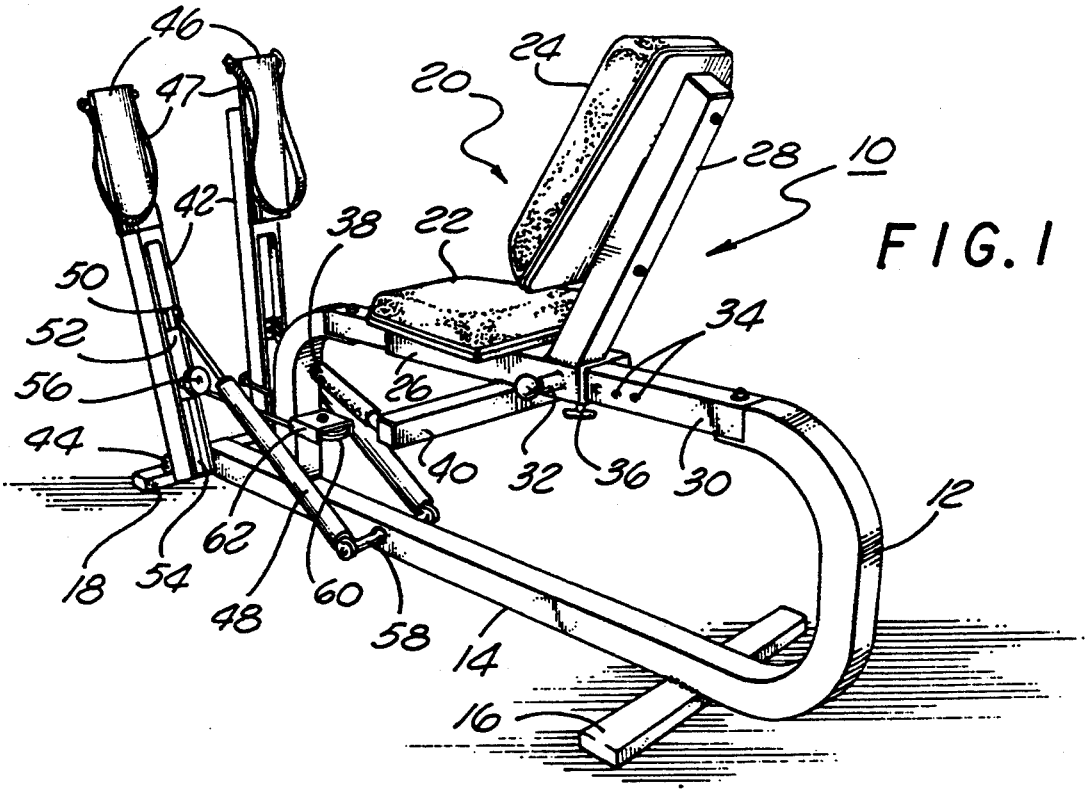
FIG. 1 is a perspective view of a recumbent leg exerciser.
Figure 3:
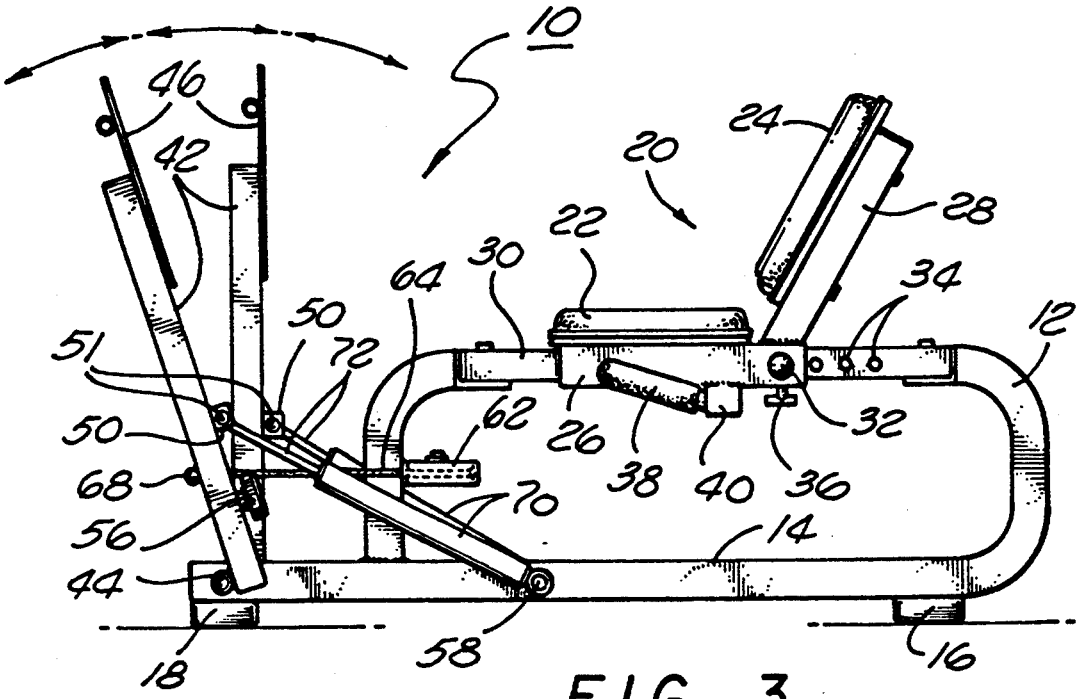
FIG. 3 is a side elevation view of the exerciser of FIG. 1.

Referring primarily to FIGS. 1 and 3, a recumbent leg exercise apparatus 10 is shown. A frame 12 comprises a base member 14 and lateral support members 16 and 18. These lateral support members extend a sufficient distance on either side of frame 12 so as to provide a stable footing for apparatus 10 on a floor surface. The principal structural components of apparatus 10 are preferably fabricated from square and rectangular steel tubing, although other steel shapes and shapes of other materials may also be employed. Lateral support members 16 and 18 are preferably welded to frame 12, but may be attached by other conventional means.

A seat 20 is provided for the user of the apparatus. Seat 20 comprises a seat cushion 22 and a back cushion 24. Cushions 22 and 24 are of conventional construction comprising, for example, a rigid substrate of plywood or similar material, a foam cushioning material and a vinyl cover. Seat cushion 22 is secured to support member 26 which is a length of tubular material of suitable dimensions so that it telescopes over frame member 30. Back cushion 24 is secured to support member 28, which is welded or otherwise secured to seat support member 26. Support member 28 is inclined with respect to member 26 at an angle for firmly and comfortably supporting the back of the user during operation of the apparatus. If desired, suitable angle adjusting means may be incorporated to selectively vary the angle of support member 28 relative to support member 26.

The longitudinal position of seat 20 on frame 12 is preferably adjustable to accommodate users of different heights. As already stated above, seat support member 26 telescopes over support member 30. A spring-loaded indexing pin 32 is provided on support member 26 for engagement with one of a plurality of indexing holes 34 drilled laterally through support member 30. To prevent any wobble of seat 20 about frame member 30 once the desired longitudinal position has been selected, locking screw 36 is provided on support member 26. Locking screw 36 is threaded through the wall of support member 26, or preferably through a nut welded to the underside of member 26. After adjusting the longitudinal position of seat 20, locking screw 36 is tightened until it firmly engages the underside of frame member 30, thereby firmly securing seat 20 in position on frame member 30.

To assist the user in maintaining a comfortably seated position while performing exercises on apparatus 10, hand grips 38 are provided on either side of seat 20. Hand grips 38 are supported by lateral support member 40 which is welded or otherwise secured to support member 26. Hand grips 38 thus remain fixed in position relative to seat 20 as the longitudinal position of seat 20 on frame 12 is adjusted. Hand grips 38 are preferably fabricated from round bar or tubing and are preferably covered with a slightly resilient material such as a high density foam for the comfort of the user.

A pair of identical footbeams 42 are pivotally mounted in laterally adjacent positions at the forward end of frame 12. Footbeams 42 are mounted on respective pivot pins 44 that extend laterally from either side of base member 14. Each of footbeams 42 pivots through an arc as indicated by the arrows in FIG. 3 such that a user may engage the footbeams with his feet and operate the footbeams through the indicated arc or a portion thereof with a pumping or striding motion. A footpad 46 is secured to the upper end of each of footbeams 42 to provide substantially flat operating surfaces for the feet of the user. Ankle straps 47 are provided at each of footpads 46 to support the user's legs while operating the exerciser.

Respective pivotal movement of each of footbeams 42 by the user is resisted by resistance means 48. Any one of a number of conventional resistance means may be employed, such as a spring arrangement or a weight and pulley arrangement. However, the preferred form of resistance means is a pneumatic or hydraulic piston assembly as illustrated. Piston assemblies 48 are attached to frame 12 by respective pivot pins 58 extending laterally from either side of base member 14. Each of piston assemblies 48 comprises a cylinder 70 and a piston rod 72. Each piston assembly 48 is preferably valved such that resistance is provided both during compression and extension. It will be appreciated that differential exercise of the leg muscle groups may be achieved by having greater or lesser resistance during compression than during extension.

The degree of resistance offered by piston assembly 48 to pivotal motion of the respective footbeam 42 may be conveniently adjusted by varying the location of the point at which piston rod 72 is coupled to the footbeam, it being recognized that a coupling point closer to footpad 46 will involve a greater stroke of piston rod 72 for a given arc of motion, thereby requiring greater effort on the part of the user. Each footbeam 42 includes a channel portion 54 within which an adjusting member 52 is slideably disposed. Adjusting member 52 includes a clevis portion 50 protruding therefrom. Piston rod 72 is pivotally coupled to clevis portion 50 by bolt 51. Adjusting member 52 is secured in position within channel portion 54 of footbeam 42 by suitable means such as locking screw 56.

Figure 2:
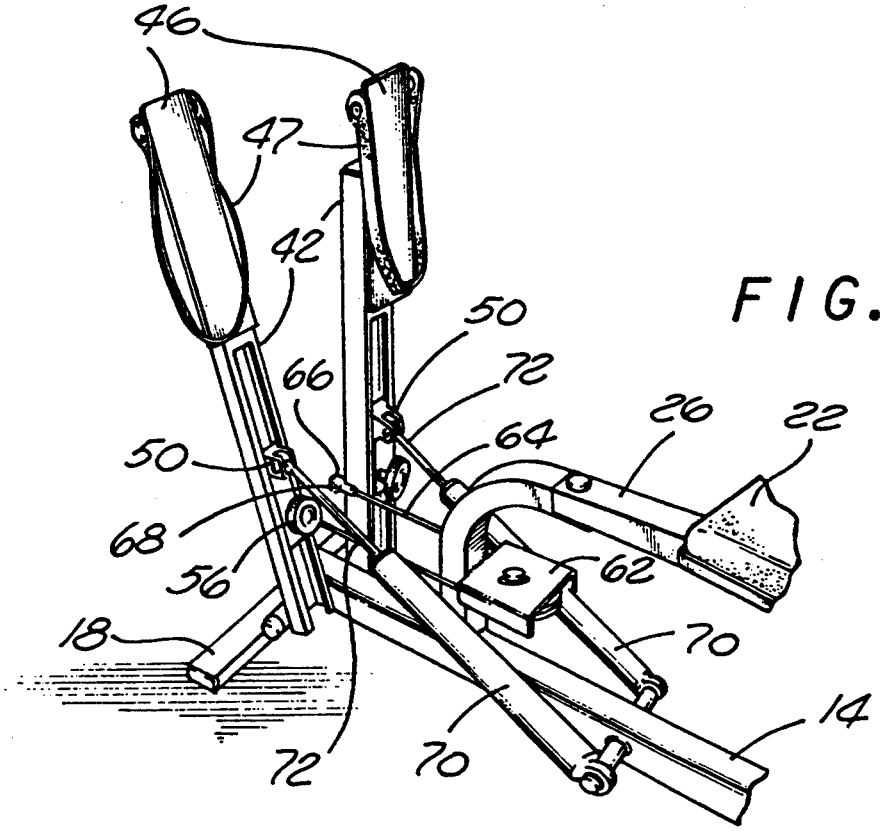
FIG. 2 is a detailed perspective view of the forward portion of the exerciser of FIG. 1.

Referring now also to FIG. 2, footbeams 42 are preferably interconnected in such a way that forward pivotal motion of one of the footbeams will cause the other footbeam to pivot rearwardly. Thus, as the user presses forward against one of the footpads, the opposite footbeam will return towards the user so that a striding exercise is achieved. In the illustrated embodiment, a pulley and cable arrangement are provided for interconnecting the footbeams. Pulley 60 is attached to frame 12 by means of bracket 62 which is welded or otherwise secured to the frame member. Cable 64 passes around pulley 60 and terminates at either end in eyelet fittings 66. The cable ends are secured to the footbeams by bolts 68 or other suitable means. While such a cable and pulley arrangement is preferred as a means of interconnecting footbeams 42, this may also be accomplished by an arrangement of levers, a chain and sprocket, gears or other conventional mechanical couplings.

Figure 4:
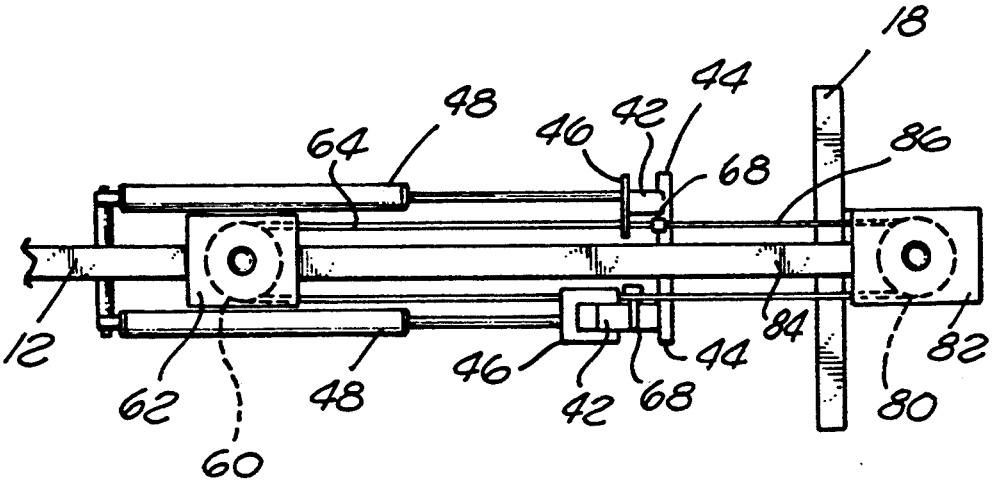
FIG. 4 is a partial plan view of a modified embodiment of the exerciser of FIG. 1.

Referring now to FIG. 4, a modification of apparatus 10 is illustrated. In the embodiment thus far described, forward pivotal motion of one of the footbeams will cause the other footbeam to pivot rearwardly. However, rearward pivotal motion of one of the footbeams will simply allow cable 64 to go slack and will have no effect on the opposing footbeam. To obtain full-time coordination of the footbeams, an additional pulley 80 may be mounted forward of the pivot points 44. Pulley 80 is mounted on bracket 82 which is supported by extended frame member 84. With extended frame member 84, lateral support member 18 is preferably located further forward for greater stability. A second cable 86 passes around pulley 80 and is attached to footbeams 42 along with cable 64 by bolts 68. Alternatively, a single cable may be employed with two end fittings coupled to one of the footbeams in a manner similar to that described for cables 64 and 86, the other footbeam having a clamping arrangement to secure the cable thereto.

FIG. 5 illustrates another recumbent leg exerciser. In apparatus 100, the pivot point at which the footbeams are coupled to the frame 104 has been moved to a location generally under the seat 110. Each footbeam comprises a forward portion 106 and a rearward portion 108. A footpad 124 is mounted at the end of forward portion 106. Although footpad 124 could be pivotally coupled to the footbeam, a fixed attachment as shown is more effective in isolating the user's calf or gluteus muscles. As shown in the drawing, the footbeams 106, 108 are pivoted at an intermediate position of each footbeam about pivot pin 126 attached to frame 104. Locating the pivot point below seat cushion 114 in this manner offers certain unique exercising advantages over the configuration of the previously described embodiment. The embodiment illustrated in FIGS. 5 and 6, which provides a recumbent lunge exercise, primarily emphasizes development of the gluteus muscle group as does a conventional lunge exercise performed with free weights, and secondarily develops the upper leg/thigh muscles as does a conventional leg press machine.

As in previous embodiments, the frame 104 rests on front lateral support member 120 and rear lateral support member 122. To provide the necessary resistance to achieve its exercise function, the apparatus 100 employs a resistance means 118 attached to the support member 102 and the footbeam rearward portion 108, just behind the footbeam pivot pin 126. The resistance means 118, shown here as a damper mechanism comprising a piston and cylinder, is coupled to apparatus 100 at pivot pin 138 and at pivot pin 140. As in the previously described embodiment, alternative resistance means, such as a weight and pulley arrangement or an electronic braking mechanism, may be employed. Hand grips 112 are provided alongside the seat cushion 114 to provide leverage for the user during his or her exercise routine.

As an additional feature, apparatus 100 also provides longitudinal adjustment of the footbeams 106, 108. Specifically, each footbeam 106, 108 is comprised of a forward portion 106 and a rearward portion 108 such that both portions are arranged coaxially and concentrically to enable a telescoping action. Accordingly, a user sitting in the seat 110 can comfortably adjust the distance the footpad 124 is away from his or her body by extending or contracting the footbeams. After this adjustment is made, a locking knob 130 frictionally holds the footbeam portions 106, 108 in their relative positions.

Adjustment of the length of the footbeams not only accommodates the physiology of the user, it also directs the benefits of the exercise to different muscle groups. Shortening the length of the footbeams will emphasize the gluteus muscles, whereas lengthening the footbeams will emphasize the quadriceps.

To adjust the resistance encountered by the user, the pivot point of the resistance means 118 on the footbeam can be adjusted by loosening locking knob 128 and sliding channel 142 longitudinally along the exterior of the footbeam rearward portion 108. When the exact amount of desired resistance is found, the user can twist the locking knob 128 to frictionally hold the channel 142 in place. The amount of resistance is simply a matter of adjusting the lever arm, which in this instance is the distance between the footbeam pivot pin 126 (the fulcrum) and the pivot pin 140 (load point).

As in the previously described embodiment, the footbeams are interconnected to achieve an alternating pedaling action. As best seen in FIG. 6, a pulley 132 is rotatably mounted to the frame 104. Cable 134 is reeved around pulley 132 and connected at each end to respective rearward portions 108 of the footbeams. Therefore, as one footbeam swings downward in front, its rear end swings up, pulling on the cable 134 and simultaneously pulling down the rear end of the other footbeam.

FIG. 7 provides a partial detailed view of an adjustable reclining seat for use with the above-described exercisers; and FIG. 8 is a sectional view taken along line 8—8 of FIG. 7. As best seen in FIG. 8, support member 202 pivots with respect to frame 204 about pivot pin 241 by means of bushing 243. Preferably, there is a significant amount of friction in this pivot joint so as to minimize the slack in the seat adjustment. FIG. 7 shows a sector-shaped plate 242 connected to support member 202, which supports back cushion 216. The sector-shaped plate 242 has along its arcuate edge a series of holes 248. To the frame 204 is affixed a mounting plate 244. On the mounting plate 244 is a locking pin 246 which is mounted perpendicular to the plate 244 and extends therethrough. When the seat 210 is installed on the frame 204, the sector-shaped plate 242 engages the mounting plate 244. Tilting the support member 202 helps align a specific hole 248 with the locking pin 246, which is biased by spring 250 to slide into the aligned hole 248. Once the two plates 242, 244 are locked together by pin 246, the angle of recline of the back cushion 216 is set.

Adjustment of the angle of back cushion 216 is useful not only for the comfort of the user, but also for physiological reasons. A greater angle of recline will lower the elevation of the heart and thereby reduce cardiac stress while exercising. Furthermore, adjusting the angle of recline will direct the benefits of the exercise to different muscle groups. A more upright position will emphasize the gluteus and hamstring muscles, whereas a more recumbent position will emphasize the quadriceps.

Because the seatback support member 202 can be reclined to various angles, the resistance means 218 cannot be conveniently attached thereto. Therefore, in this alternative embodiment, the resistance means 218 is pivotally attached to the main structural frame. In other words, instead of interconnecting the footbeam to the seatback support member as shown in the previous embodiment, the resistance means 218 interconnects the frame 204 or optionally the rear lateral support member 222 to the footbeam rearward portion 208.

Naturally, the reclining action of the back cushion 216 can be adapted to operate on the seat cushion 214 as well. The apparatus 200 can thus have a combination of a reclining back cushion 216 and a tilting seat cushion 214.

Figure 9:
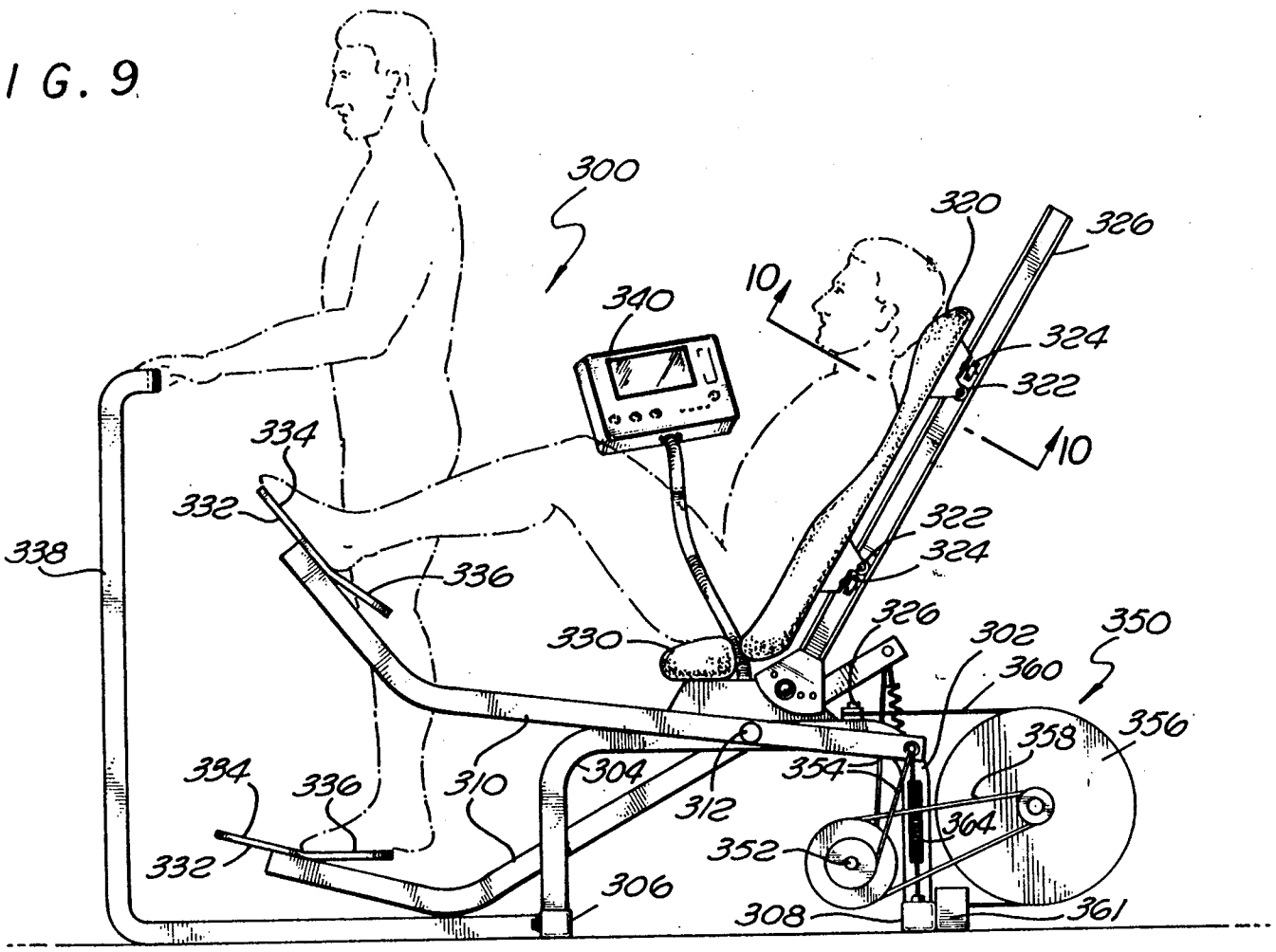
FIG. 9 is a side elevation view of a semi-recumbent leg exerciser incorporating a moveable backrest.

FIG. 9 illustrates a preferred embodiment of the present invention. Apparatus 300 is similar in many respects to exerciser 100 described above. However, apparatus 300 incorporates a "floating" backpad feature that offers substantial benefits in terms of the exercises that can be performed with the apparatus.

Frame 302 comprises a central member 304, a front transverse member 306 and a rear transverse member 308. As with the previously described exercisers, the frame members are preferably fabricated from square or rectangular section steel tubing and are fastened to one another by welded joints or suitable mechanical fasteners. A pair of beams 310 are pivotally coupled to frame 302 at pivot point 312. In this embodiment, it is not necessary to provide telescopically adjustable beams since the "floating" backpad feature inherently adjusts to the proportions of the particular user.

Backrest 320 supports the posterior portions of the user while exercising on apparatus 300. The backrest may comprise a conventional padded cushion, although it is preferred that backrest 320 be molded to the contours of the human body. Backrest 320 supports at least the lower back in the sacral region and preferably extends upward to support the upper torso and head as illustrated. The backrest also preferably extends down sufficiently far to partially support the buttocks. Backrest 320 is mounted on rollers 322 and 324 which ride on guide member 326. As best seen in FIG. 10, guide member 326 has a generally "I" shaped cross section. Rollers 324 guide the backrest along central web 327, whereas longitudinal loads are supported by rollers 322. Backrest 320 is thus moveable along the length of guide member 326 for reasons that are more fully explained below. Other arrangements for movably supporting backrest 320 will be apparent to those with ordinary skill in the design of mechanical devices and come within the scope of this invention. Although guide member 326 is shown as providing a linear path of travel for backrest 320, guide member 326 may also be curved to vary the angle of inclination of backrest 320 as it moves up and down. In any case, the angle of inclination of guide member 326 is preferably adjustable in the same manner as illustrated in FIGS. 7 and 8. In addition to the comfort and physiological advantages of a reclining backrest previously discussed, adjusting the angle at which the backrest is inclined allows the user to vary the resistance and effort level at which the user is able to stay "afloat".

A small seat cushion 330 is secured to frame 302 in a position immediately below backrest 320. Cushion 330 provides additional support for the user in the rest position, i.e., when backrest 320 is at the lower limit of its travel as shown in FIG. 9.

Footpads 332 are attached at the forward ends of each of beams 310. Each of footpads 332 has a forward operating surface 334 and a rearward operating surface 336. Surfaces 334 are intended for use when the, user is supported in a semi-recumbent position by backrest 320. Surfaces 336 enable apparatus 300 to also be utilized in the manner of a conventional stair-climbing simulator. In this mode of operation, the user stands upright on surfaces 336. Support bar 338, which may be an optional accessory, is provided for this purpose. If desired, footpads 332 may be angularly adjustable with respect to beams 310, in which case a single operating surface will suffice. Moreover, it may be desirable, to have footpads 332 mounted on beams 310 such that they are freely pivotal about a horizontal transverse axis. In general, however, fixed footpads are preferred, particularly in a club environment where it is desirable to minimize the number of mechanical adjustments on an exercise apparatus.

Apparatus 300 may incorporate various electronic control and resistance functions. A control panel 340 may be provided for these purposes, such panel being preferably positionable for convenient access by the user. The control panel may also incorporate electronic displays to keep the user informed of the progress of the exercise routine.

Resistance to pivotal motion of beams 310 is provided by resistance means shown generally as 350. As with the previously described embodiments of recumbent exercisers, a variety of resistance devices may be employed. In order to achieve the most advantageous benefits of apparatus 300, beams 310 should be independently operable with resistance provided only on the downstroke of each beam and an assisted return to the elevated position. Resistance mechanisms that have been developed for conventional stair-climbing simulators are particularly well suited for use with apparatus 300. For example, U.S. Pat. No. 4,938,474, issued to Sweeney et al. describes a mechanism in which resistance is provided by tightening a belt around the perimeter of a flywheel. The flywheel is driven with a chain and sprocket from a driveshaft which is coupled to the operating pedals through one-way clutches. When either of the operating pedals is moved downwardly, the associated one-way clutch transfers energy to the drive shaft and thence to the flywheel. When either of the operating pedals is moving upwardly, no energy is transferred. The pedals are biased upwardly by springs.

The resistance means 350 shown in FIG. 9 is substantially identical to that of Sweeney et al. Pedals 310 are coupled to driveshaft 352 by cables 354. Flywheel 356 is driven from driveshaft 352 by chain or toothed belt 358. A friction belt 360 is wrapped around the perimeter of flywheel 356 and secured at one end to frame 302. Friction belt 360 may be tensioned by a motor or similar means 361 in the manner described by Sweeney et al. Alternatively, friction belt 360 may be tensioned by a manual adjustment means 362. However an electronic means for varying the resistance is greatly preferred since this facilitates mounting the apparatus in the manner described below and also permits the level of resistance to be conveniently controlled from panel 340 with suitable electronic control devices.

Other well known resistance mechanisms developed for stair-climbing simulators may also be used. For example the mechanism described in U.S. Pat. No. 4,949,993, issued to Stark et al. (an improvement over the mechanism of U.S. Pat. No. 4,938,474) would be suitable. Another suitable electromechanical resistance mechanism, one which utilizes the dynamic braking effect of an electrical generator in lieu of a flywheel, is described in U.S. Pat. No. 4,708,338, issued to Potts.

In the primary intended mode of operation of apparatus 300, the user begins by sitting on seat cushion 330 with backrest 320 in its lowest, rest position as illustrated in FIG. 9. Both of beams 310 are initially in their elevated positions by the action of springs 364 or other suitable biasing means. Prior to commencement of the exercise routine, resistance means 350 provides a high level of resistance to restrain the beams in their elevated positions. The user places both feet on respective footpads 332 and pushes upward to elevate the backpad along guide member 326 as illustrated in FIG. 11. Once elevated, the user then commands the resistance means to gradually decrease the level of resistance to a level pre-selected for the exercise routine. This may be accomplished, for example, by pressing a start button located on control panel 340. Alternatively, a switch may be mounted on guide member 326 to sense when backrest 320 has been elevated above the rest position, at which time the level of resistance may be automatically reduced.

Absent any action on the part of the user, as the level of resistance is gradually reduced, both of beams 310 will slowly descend as a result of the weight of the user acting against the reduced resistance afforded by means 350. However, by operating the beams in a striding motion such that the user alternately extends his legs against the footpads, the user is forced upward with each leg extension. By striding at a sufficiently fast pace, the user can maintain himself and backrest 320 in an elevated "floating" position. The goal of the user is thus to remain in a "floating" position with the backrest above its rest position. A visual display of the backrest position may be provided for the user's convenience on control panel 340. In addition, controls are preferably provided with which the user may increase or decrease the level of resistance. This will influence the rate of descent of the pedals and thereby adjusts the level of effort required to remain in a "floating" position.

It will be recognized that the above described invention may be embodied in other specific forms without departing from the spirit or essential characteristics of the disclosure. Thus it is understood that the invention is not to be limited by the foregoing illustrative examples except as set forth in the appended claims.

I claim:

1. An exercise apparatus comprising:

a frame;

a support for supporting a user of said apparatus in a generally semi-recumbent posture;

a pair of pedals independently movably coupled to the frame for movement between an elevated position and a depressed position, each pedal having a footpad for engagement by a respective foot of the user; and resistance means coupled to the pair of pedals for resisting a downstroke of each pedal to the depressed position and for assisting return of each pedal to the elevated position;

wherein said support is freely movable from a lower rest position to a range of elevated positions during the user's operation of the pedals at a rate sufficient to prevent the pedals from descending to their respective depressed positions and wherein the apparatus lacks means for restricting movement of the support within the range of elevated positions.

2. The apparatus of claim 1 wherein the frame includes an inclined guide member behind the support and the support is movable engaged therewith.

3. The apparatus of claim 2 wherein the guide member is pivotally coupled to the frame and further including adjustment means for adjusting the angle of inclination of the guide member.

4. The apparatus of claim 1 wherein the footpad has first and second operating surfaces inclined with respect to each other.

5. The apparatus of claim 4 wherein one of the first and second operating surfaces is oriented for the user to stand generally upright on the pair of footpads for utilizing the apparatus in a stair-climbing mode.

6. The apparatus of claim 5 further comprising a hand rail coupled to the frame at a forward position thereof disposed for grasping by the user when standing generally upright on the pair of footpads.

7. The apparatus of claim 1 further comprising a seat attached to the frame at a location adjacent to a lower portion of the support when the support is in the rest position.

8. The apparatus of claim 1 further comprising means for restraining the pedals in an elevated starting position.

9. The apparatus of claim 1 wherein the resistance means comprises a uni-directional driveshaft coupled to each of the pair of pedals, a flywheel, and means for transferring rotational energy from the driveshaft to the flywheel.

10. The apparatus of claim 9 further comprising means coupled to the flywheel for retarding rotation thereof.

11. An exercise apparatus comprising:

a frame;

a guide member coupled to the frame;

a support slideably coupled to the guide member for supporting a user of said apparatus in a generally semi-recumbent position, said support being freely slideable along the guide member in a partially vertical direction while the apparatus is in use; a pair of pedals coupled to the frame for independent movement between an elevated position and a depressed position, each pedal having a footpad at a forward end thereof for engagement by a respective foot of the user; and resistance means coupled to the pair of pedals for resisting a downstroke of each pedal to the depressed position and for assisting return of each pedal to the elevated position;

wherein said support is movable from a lower rest position to a range of elevated positions during the user's operation of the pedals at a rate sufficient to prevent the pedals from descending to their respective depressed positions and wherein the apparatus lacks means for restricting movement of the support within the range of elevated positions.

12. The apparatus of claim 11 wherein the guide member is pivotally coupled to the frame and further including adjustment means for adjusting an angle of inclination of the guide member.

13. The apparatus of claim 11 wherein each of the footpads has first and second operating surfaces inclined with respect to each other.

14. The apparatus of claim 13 wherein one of the first and second operating surfaces is oriented for the user to stand generally upright on the pair of footpads for utilizing the apparatus in a stair-climbing mode.

15. The apparatus of claim 11 further comprising a seat attached to the frame at a location adjacent to a lower portion of the support when the support is in the rest position.

16. The apparatus of claim 11 wherein the resistance means comprises a uni-directional driveshaft coupled to each of the pair of pedals, a flywheel, and means for transferring rotational energy from the driveshaft to the flywheel.

17. The apparatus of claim 16 further comprising means coupled to the flywheel for retarding rotation thereof.

18. The apparatus of claim 11 further comprising means for restraining the pedals in the elevated starting position.

19. A method of performing a lower body exercise comprising the steps of:

(a) providing an exercise apparatus having:

(i) a frame;

(ii) a support movably coupled to the frame for supporting a user of the apparatus in a generally semi-recumbent posture, said support being freely movable between a rest position and a range of elevated positions;

(iii) a pair of pedals movably coupled to the frame for movement between an elevated position and a depressed position, each pedal having a footpad for engagement by a respective foot of the user;

(iv) means coupled to the pair of pedals for resisting a downstroke of each pedal to the depressed position and for assisting return of each pedal to the elevated position;

(b) positioning a posterior portion of the user's body on the support;

(c) positioning the user's feet on respective ones of the footpads;

(d) the user striding alternately against the footpads at a rate sufficient to maintain the user's body and support within the range of elevated positions.

20. The method of claim 19 further comprising the step, before step (c), of setting resistance to the downstroke of at least one of the pedals to a high level.

21. The method of claim 20 further comprising the step, before step (d), of reducing said high level of resistance to a lower level.

* * * * *